US007938865B2

(12) United States Patent
Fernandez Cid et al.

(10) Patent No.: US 7,938,865 B2
(45) Date of Patent: May 10, 2011

(54) METHOD OF DYEING A SUBSTRATE WITH A REACTIVE DYESTUFF IN SUPERCRITICAL OR NEAR SUPERCRITICAL CARBON DIOXIDE

(75) Inventors: Maria Vanesa Fernandez Cid, Haarlem (NL); Geert Jan Witkamp, Bergschenhoek (NL); Kathryn Nicole Teesink-Gerstner, Leiden (NL); Wilhelmus Johannes Theodorus Veugelers, Kessel (NL); Geert Feye Woerlee, Haarlem (NL)

(73) Assignee: Feyecon Development & Implementation B.V., Weesp (NL)

( * ) Notice: Subject to any disclaimer, the term of this patent is extended or adjusted under 35 U.S.C. 154(b) by 557 days.

(21) Appl. No.: 11/718,594

(22) PCT Filed: Nov. 4, 2005

(86) PCT No.: PCT/NL2005/050032

§ 371 (c)(1),
(2), (4) Date: Jun. 29, 2007

(87) PCT Pub. No.: WO2006/049503

PCT Pub. Date: May 11, 2006

(65) Prior Publication Data

US 2008/0005854 A1 Jan. 10, 2008

(30) Foreign Application Priority Data

Nov. 4, 2004 (EP) ..... 04078036

(51) Int. Cl.
*C09B 62/00* (2006.01)
*D06P 1/94* (2006.01)

(52) U.S. Cl. ..... 8/543; 8/544; 8/474; 8/475

(58) Field of Classification Search ..... 8/544
See application file for complete search history.

(56) References Cited

U.S. PATENT DOCUMENTS 5,298,032 A * 3/1994 Schlenker et al. ..... 8/475
5,578,088 A 11/1996 Schrell et al.
6,010,542 A * 1/2000 DeYoung et al. ..... 8/474
2001/0020311 A1 9/2001 Veugelers et al.
2002/0040510 A1 * 4/2002 Brierley et al. ..... 8/445
2008/0028541 A1 2/2008 Fernandez Cid et al.

FOREIGN PATENT DOCUMENTS

| | | | |
|---|---|---|---|
| DE | 199 37 328 | | 3/2000 |
| EP | 1 126 072 | | 8/2001 |
| JP | 2002-004169 | A | 1/2002 |
| JP | 2002-201575 | | 7/2002 |
| JP | 2002371483 | A * | 12/2002 |
| WO | WO 01/04410 | A | 1/2001 |
| WO | WO 2006/107191 | | 10/2006 |

OTHER PUBLICATIONS

Derwent Abstract Acc. No. 2003-620756, English abstract for JP 2002-371483 A.*
English Machine Translation of JP 2002-371483A.*
Schmidt, A. et al., "The dyeing of natural fibres with reactive disperse dyes in supercritical carbon dioxide", *Dyes and PigmentsI*, vol. 56, No. 1, pp. 27-35, Jan. 2003.
Maeda et al., "Dyeing Cellulose Fibers with Reactive Disperse Dyes in Supercritical Carbon Dioxide", *Textile Res. J.*, vol. 72, No. 3, pp. 240-244, 2002.
U.S. PTO Office Action corresponding to U.S. Appl. No. 11/718,699, dated Apr. 10, 2009.
U.S. PTO Notice of Allowance and Fee(s) Due corresponding to U.S. Appl. No. 11/718,699, dated Feb. 1, 2010.
International Search Report in PCT/NL2005/050032 dated Jun. 6, 2006.

* cited by examiner

*Primary Examiner* — Harold Y Pyon
*Assistant Examiner* — Katie Hammer
(74) *Attorney, Agent, or Firm* — Gilberto M. Villacorta; Sunit Talapatra; Foley & Lardner, LLP

(57) ABSTRACT

The present invention relates to a method of dyeing a substrate with a reactive dyestuff in supercritical or near supercritical carbon dioxide, said substrate being selected from the group consisting of cellulose fibers, modified cellulose fibers, protein fibers and of synthetic fibers, or any combination thereof, wherein the method comprises the subsequent steps of: pre-treating the substrate by wetting the substrate with a fluid medium containing at least 10 wt. %, preferably at least 40 wt. % of one or more organic hydrogen bond acceptor compounds selected from the group consisting of C1-C6 alkanols, dimethyl sulfoxide, dimethylformamide, acetone, butan-2-one, dimethyl ether, methyl acetate and ethyl acetate; dyeing the substrate by contacting the pre-treated substrate with supercritical or near supercritical carbon dioxide containing a reactive dyestuff.

10 Claims, No Drawings

METHOD OF DYEING A SUBSTRATE WITH A REACTIVE DYESTUFF IN SUPERCRITICAL OR NEAR SUPERCRITICAL CARBON DIOXIDE

TECHNICAL FIELD OF THE INVENTION

The present invention relates to a method of dyeing a substrate, particularly fibres, with a reactive dyestuff in supercritical or near supercritical carbon dioxide.

BACKGROUND OF THE INVENTION

Dyeing by traditional water-based methods and subsequent washing processes produces large amounts of, usually strongly coloured, waste water. Furthermore, when dyeing, for instance, polyester fibres from an aqueous medium, the dyed fibres need to be subjected to a so called reduction clearing which causes additional effluent problems.

The aforementioned environmental drawbacks of water-based dyeing methods can be overcome by dyeing from supercritical carbon dioxide. Supercritical dyeing additionally offers the advantage that densities and viscosities in supercritical carbon dioxide are lower and diffusion more rapid than in liquids, shortening the process time.

The dyeing of substrate materials in liquid or supercritical carbon dioxide is well-known in the art. It is also known to employ reactive dyeing substances in supercritical dyeing methods that are capable of reacting with the substrate under the formation of a chemical bond. These reactive substances are usually derivatives of $CO_2$-soluble disperse dyestuffs (chromophores) that contain a reactive group that is capable of reacting with specific residues in the substrate.

Unfortunately, supercritical dyeing methods employing the aforementioned reactive dyestuffs have been found to produce disappointing colour yields and to suffer from poor fixation of the dye to the substrate. Several attempts have been made to modify the dyeing methodology in order to obtain more satisfactory results with these reactive dyestuffs.

It has been proposed, for instance, to pre-treat the substrate prior to dyeing in order to enhance the reaction rate between the substrate and the reactive dye. One advocated approach is to chemically modify the substrate by treating the substrate with one or more reactants capable of reacting with reactive groups in the substrate. U.S. Pat. No. 5,578,088 describes a process for dyeing fibre materials comprising cellulose fibres or a mixture of cellulose fibres and polyester fibres, which comprises first modifying the fibre material with one or more compounds containing amino groups and then dyeing the modified fibre material with a fibre-reactive disperse dyestuff in supercritical $CO_2$.

U.S. Pat. No. 5,298,032 describes a process for dyeing cellulose textile material with disperse dyes, which comprises pretreating the textile material at least 5% by weight of an auxiliary that promotes dye uptake and subsequently dyeing the pre-treated material with a disperse dye from supercritical $CO_2$, the auxiliary being selected from the group consisting of a polyalkylene glycol, an alkanolamine and an aromatic compound with several hydroxyl groups.

Maeda et al. (Dyeing Cellulose Fibers with Reactive Disperse Dyes in Supercritical Carbon Dioxide, Textile Res. J. 72(3), 240-244 (2002)) describe the results of experiments in which cellulose fibres are dyed from supercritical carbon dioxide following pre-treatment with tetraethylene glycol dimethylether or N-methyl-2-pyrrolidinone, using reactive dyestuffs that comprise a triazine group for reaction with a hydroxyl group of cellulose fibres. The results show that pre-treatment improves the colour yield. The authors speculate that the pre-treatment solution can swell the cellulose fibres. In addition, the hypothesis that the pre-treatment solvents used are capable of forming hydrogen bonds with the cellulose chains which might help to prevent the complete deswelling of the fibres during the supercritical carbon dioxide treatment.

Japanese patent application 2002-201575 describes a method of dyeing a cellulosic fibre material, said method comprising pretreating the fibre material with a polar solvent capable of swelling the fibre and an alkali agent, followed by dying with a reaction disperse dye in a mixed fluid of supercritical carbon dioxide and a polar solvent such as ethanol, acetone etc. As examples of polar solvents capable of swelling the fibre ethylene glycol derivative and N-methylpyrrolidone are mentioned.

Despite the use of reactive dyestuffs and pre-treatment with reactants or organic solvents, known methods of supercritical dyeing have produced colour yields and wash-fastening properties that can be qualified as disappointing, especially in case these techniques are employed to dye cellulose fibres (e.g. cotton).

SUMMARY OF THE INVENTION

The inventors have unexpectedly found that the disadvantages of the supercritical dyeing methods from the prior art can be largely removed by first pre-treating the substrate by wetting it with a fluid medium containing one or more relatively small organic hydrogen bond acceptor compounds followed by dyeing the substrate by contacting the pre-treated substrate with supercritical or near supercritical carbon dioxide containing a reactive dyestuff. More particularly, the inventors have found that excellent results can be obtained by pre-treating the substrate with one or more hydrogen bond acceptor compounds selected from the group consisting of $C_1$-$C_6$ alkanols, dimethyl sulfoxide, dimethylformamide, acetone, butan-2-one, dimethyl ether, methyl acetate and ethyl acetate and containing no reactive dyestuff.

The present method provides excellent fixation of the dyestuff in combination with exceptionally high reaction rates. Furthermore, the present method enables the production of dyed substrates that exhibit outstanding washfastness and fastness to rubbing. An important advantage of the present method is that very good dyeing results can be obtained without prior chemical modification of the substrate.

Although the inventors do not wish to be bound by theory, it is believed that the benefits of the present method are largely due to the exceptionally high reactivity of the reactive dyestuff under supercritical dyeing conditions following the pre-treatment with the hydrogen bond acceptor compounds. Although the inventors do not wish to be bound by theory, it is believed that such pre-treatment makes the reactive sites in the substrate more accessible to the reactive dyestuff. Furthermore, the pre-treatment appears to have a favourable effect on the reaction rate.

DETAILED DESCRIPTION OF THE INVENTION

Accordingly, the invention relates to a method of dyeing a substrate with a reactive dyestuff in supercritical or near supercritical carbon dioxide, said substrate being selected from the group consisting of cellulose fibres; modified cellulose fibres; protein fibres; synthetic fibres containing a plurality of reactive groups selected from the group consisting of hydroxyl, thiol, primary amine and secondary amine; and combinations of these fibres, wherein the method comprises the subsequent steps of:

pre-treating the substrate by wetting the substrate with a fluid medium containing at least 10 wt. %, preferably at least 40 wt. % of one or more organic hydrogen bond acceptor compounds selected from the group consisting of $C_1$-$C_6$ alkanols, dimethyl sulfoxide, dimethylformamide, acetone, butan-2-one, dimethyl ether, methyl acetate and ethyl acetate;

dyeing the substrate by contacting the pre-treated substrate with supercritical or near supercritical carbon dioxide containing a reactive dyestuff.

The fibre substrate in the present method can suitably take the shape of yarn or fabric. The present method is particularly suitable for dyeing fabrics, e.g. woven or knitted fabrics.

The term "fluid medium" as used in here encompasses liquid as well as supercritical media.

The term "reactive dyestuff" as used in here refers to dyestuffs, which are capable of reacting and forming a covalent bond with reactive groups in the substrate under the conditions employed in the present method. Examples of reactive groups include hydroxyl groups (cellulose based materials such as cotton), amino and thiol groups (wool, silk, polyamides).

The term "supercritical carbon dioxide" as used in here refers to carbon dioxide that exhibits a pressure and temperature equal to or above its critical pressure and critical temperature (73.8 bar; 31.1° C.). The dyeing method according to the present invention can also employ carbon dioxide under near supercritical conditions, i.e. at a pressure of at least 50 bar and a temperature of at least 15° C.

The pre-treatment according to the present invention may suitably be carried out by rinsing or soaking the substrate in the fluid medium. The subsequent step of contacting the substrate with supercritical or near supercritical carbon dioxide containing the reactive dyestuff may be effected by simply adding the supercritical or near supercritical carbon dioxide or by separating the substrate from the fluid medium and subsequently adding the carbon dioxide. It is preferred to first separate the substrate from the fluid medium before the dyeing step. Following removal of the substrate from the fluid medium some of the fluid medium clinging to the substrate may be removed by e.g. wiping, wringing or evaporation. However, it is strongly preferred that a significant amount of the fluid medium remains attached to the substrate when it is contacted with the carbon dioxide containing the reactive dyestuff. Typically, when contacted with the reactive dyestuff, the substrate contains at least 25%, preferably at least 50% of fluid medium by weight of the substrate (including said fluid medium).

According to a very preferred embodiment, the hydrogen bond acceptor compounds employed in the pre-treatment are selected from the group of $C_1$-$C_5$ alkanols, particularly $C_1$-$C_5$ alkanols comprising not more than 2 hydroxyl groups, even more particularly $C_1$-$C_5$ alkanols comprising one hydroxyl group. Especially suited hydrogen bond acceptor compounds are primary alcohols, secondary alcohols and combinations thereof. Examples of alcohols that may advantageously be employed in the pre-treatment of the substrate include methanol, ethanol, propanol, iso-propanol, n-butanol and 2-butanol.

The one or more hydrogen bond acceptors are advantageously employed in the pre-treatment in an amount of at least 30%, preferably at least 50% by weight of the substrate. In one particular embodiment of the invention, the present pre-treatment is carried out with a fluid medium essentially consisting of one or more organic hydrogen bond acceptor compounds. In another embodiment, the fluid medium employed in the pre-treatment may suitably contain other fluid components beside the hydrogen bond acceptor compounds. Examples of fluid components that may be included additionally are densified carbon dioxide, water, $C_1$-$C_8$ alkanes, acetone and acetonitrile. Preferably, the fluid medium employed in the treatment essentially consists of a blend of the hydrogen bond acceptor compounds and a fluid component selected from the group consisting of densified carbon dioxide, water, $C_1$-$C_8$, alkanes, acetonitrile and combinations thereof. Even more preferably, the latter fluid component is selected from the group consisting of densified carbon dioxide, acetonitrile and combinations thereof. Most preferably, the fluid component is densified carbon dioxide, especially supercritical or near supercritical carbon dioxide. The use of a mixture of the hydrogen bond acceptor compounds and supercritical or near supercritical carbon dioxide offers the advantage that pre-treatment and dyeing may be carried out in the same equipment.

The pre-treatment step is suitably carried out at a temperature of 5-160° C. and a pressure of 0.5-300 bar. In case the fluid medium does not contain densified carbon dioxide, pre-treatment is preferably carried out at a temperature of 5-50° C. and a pressure of 0.5-2 bar.

During pre-treatment the substrate is preferably contacted with the fluid medium for at least 5 minutes, more preferably for at least 10 minutes and most preferably for at least 15 minutes. Furthermore, the substrate is advantageously pre-treated employing a substrate to medium ratio (w/w) of 1:1 to 1:100, more preferably of 1:1 to 1:10.

In another preferred embodiment of the present method, the supercritical or near supercritical carbon dioxide comprising the reactive dyestuff contains between 1 and 35% by weight of carbon dioxide of a co-solvent selected from the group consisting of one or more organic hydrogen bond acceptor compounds with 1-10 carbon atoms, said hydrogen bond acceptor compounds containing organic one or more functionalities selected from hydroxyl, ester, ketone, sulfoxide, sulfone, ether, amine oxide, tertiary amide, phosphate, carbonate, carbamate, urea, phosphine oxide and nitrile. The use of a co-solvent offers the advantage that it accelerates transfer of the reactive dye to the substrate and improves the reaction of the dyestuff with the substrate.

According to preferred embodiments of the invention the co-solvent is selected from the same group of hydrogen bond acceptor compounds as defined above in relation to the embodiment using a pre-treatment step. Even more preferably, the co-solvent is identical to the hydrogen bond acceptor compound that was used in the pre-treatment.

Substrates that may be dyed by the method of the present invention include, but are not limited to fibres formed from cotton, wool, silk, polyester, nylon, rayon, acrylic fibres, acetate (particularly cellulose acetate), including blends thereof such as cotton/polyester blends, as well as leather. Preferably, the substrate is a fibre formed from cotton, wool, silk, polyester, nylon, rayon or any combination thereof. Even more preferably, the substrate is a fibre formed from cotton, wool, silk or polyester. Best results are obtained when the present method is employed in the dyeing of cotton.

In particular, textile substrates are advantageously dyed by the present method and encompass a larger number of materials. Examples of such substrates include, for example, cloth, garments, upholstery, carpets, tents, canvas, leather, footwear, silks and other water sensitive fabrics.

In a preferred embodiment, the substrate is contacted with the supercritical or the near supercritical carbon dioxide containing the reactive dyestuff at a temperature in the range of 80-300° C., preferably in the range of 90-180° C., and a pressure in the range of 60-500 bar, preferably in the range of 73-400 bar.

Typically, in the present method the substrate is dyed employing a ratio substrate to carbon dioxide of less than 2:1, preferably of less than 1:1 and even more preferably of less than 1:2. The aforementioned ratio usually exceeds 1:100. More preferably, the ratio exceeds 1:20.

According to yet another preferred embodiment of the present dyeing method the supercritical or near supercritical carbon dioxide contains at least 0.05 mol. %, more preferably at least 0.2 mol. % and most preferably at least 1 mol. % acids calculated on the molar amount of reactive dyestuff that is used in the dyeing process. It was unexpectedly found that the addition of acids to the supercritical or near supercritical carbon dioxide substantially increases the reaction rate of the dyestuff with the substrate. It is believed that the acidification of the carbon dioxide in accordance with the invention promotes protonation of the reactive group of the reactive dyestuff. As a result the reactive dyestuff will be activated and react much more rapidly with the reactive groups in the substrate.

The one or more acids employed in accordance with this embodiment of the invention preferably exhibit an acid dissociation constant K at 25° C. within the range of $4\times10^{-7}$ to $1\times10^{7}$, more preferably within the range of $7.2\times10^{-4}$ to $6\times10^{-1}$ In case the present method employs a strong acid, a relatively low acid concentration may be employed whereas much higher concentrations of a weak acid may be required to achieve the same effect. Thus, in a preferred embodiment, the one ore more acids employed in the method meet the following requirement: $K\times C\geqq0.03$; wherein K represents the acid dissociation constant at 25° C. and C represents the molar concentration of dissolved acids in the carbon dioxide. In case the carbon dioxide contains more than one acid, the above equation is applied to each acid and the results are added up to produce the final number.

The one or more acids are advantageously selected from the group consisting of HCl, $C_6H_5SO_3$, $HNO_3$, $CF_3COOH$, $H_3PO_3$, $HClO_2$, $H_3PO_4$, $CH_2ClCOOH$, HF, $HNO_2$, HCOOH, $C_6H_5COOH$, $CH_3COOH$ and $H_2CO_3$.

According to a preferred embodiment of the invention the reactive dyestuff employed is a chromophore derivative containing a chromophoric residue and a reactive group, said reactive group comprising a cyclic or heterocyclic aromatic residue that has been substituted with at least one radical selected from the group consisting of halide, substituted or unsubstituted alkoxy, substituted or unsubstituted amine, substituted or unsubstituted thiol. In a particularly preferred embodiment the aforementioned reactive group is a substituted triazine, especially a halide substituted triazine.

Particularly good results have been obtained with the present method if it employs a reactive dyestuff of the formula (I):

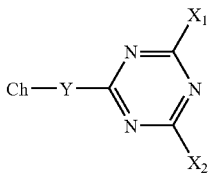

wherein

Ch represents a chromophoric residue;

Y represents O or NR, in which R represents hydrogen or a $C_1$-$C_8$ alkyl, which is optionally substituted by hydroxy, cyano, chloro, bromo, $C_1$-$C_5$ alkoxy, phenoxy, phenyl or phenoxy $C_1$-$C_4$-alkoxy;

$X_1$ represents fluorine;

$X_2$ represents fluorine, chlorine, $OR_1$, $SR_1$, $N(R_2)R_3$ or $P(O)(OH)R_4$;

$R_1$ represents hydrogen, or a $C_1$-$C_4$ alkyl, which is optionally substituted by hydroxy, cyano, fluorine, chlorine or bromine;

$R_2$ and $R_3$ independently represent hydrogen, $P(O)(OH)R_4$ or a $C_1$-$C_3$ alkyl which is optionally substituted by hydroxy, cyano, fluorine, chlorine or bromine; and $R_4$ represents hydroxy, fluorine, chlorine or bromine.

The term "chromophoric residue" as used in here refers to the part of the reactive dyestuff molecule that is primarily responsible for its colouring imparting properties. Reactive dyes that may be used to carry out the present invention include, but are not limited to, triazine derivatives of azo (mono, di, poly), carbonyl, sulphur, methine, and triarylcarbonium dyes. Examples of specific reactive dyes that may suitably be employed in the present method include triazine derivatives of azo, anthraquinone, mordant and benzothiazoleazo disperse dyes.

According to a particularly preferred embodiment of the invention the chromophoric residue in the reactive dyestuff is a residue of an aromatic diazo substance or an anthraquinone substance. Even more preferably, the residue Ch represents an arylazoarylamino residue wherein each of the aryl groups can carry 1-5 substituents.

In the aforementioned formula (I) $X_2$ preferably represents fluorine, chlorine, $OR_1$ or $N(R_2)R_3$. More preferably, $X_2$ represents fluorine, $(NH)R_2$ or $OR_1$. Most preferably, $X_2$ represents fluorine, $OCH_3$, $OCH_2CH_3$, $NH_2$ or $NHCH_3$.

In another preferred embodiment of the invention $R_1$ represents a $C_1$-$C_3$ alkyl, which is optionally substituted by hydroxy, cyano, fluorine, chlorine or bromine. Even more preferably, $R_1$ represents a $C_1$-$C_3$ alkyl, which is optionally substituted by hydroxy, fluorine or chlorine. Most preferably, $R_1$ represents methyl or ethyl.

In formula (I) Y preferably represents NR. The residue R in NR preferably represents hydrogen or a $C_1$-$C_5$ alkyl, which is optionally substituted by hydroxy, cyano, chloro, bromo or $C_1$-$C_3$ alkoxy. Even more preferably, R represents hydrogen, methyl or ethyl. Most preferably, R represents hydrogen.

The invention is further illustrated by means of the following examples.

EXAMPLES

Example 1

A piece of 0.25 g of mercerized cotton was pre-treated in a fluid medium consisting of 20 g of methanol as hydrogen bond acceptor. The pre-treatment was carried out at 40° C. and 1 bar by immersing the cotton in the methanol and gently shaking for 12 h. The pre-treated cotton was removed from the fluid medium and transferred as such for dyeing treatment. The remaining methanol in the cotton after the pre-treatment was about 60% by weight of the cotton substrate.

The dyeing test was carried out in a high-pressure batch reactor designed to carry out experiments under supercritical conditions. The reactor consisted of a 150 mL pressure vessel provided with a pressure manometer and a needle valve.

The piece of pre-treated cotton was placed into the batch reactor together with the reactive disperse dye (4,6-difluoro-N-[4-(phenyldiazinyl)phenyl]-1,3,5-trazin-2-amine) and a co-solvent. The amount of dye used was 10% by weight of the fibre (owf). The applied co-solvent was methanol at a concentration of 2% by weight of carbon dioxide. The reactor was sealed and afterwards, 90 g of liquid carbon dioxide were introduced into the reactor via the needle valve. The reactor was subsequently placed in a thermostatic bath at 120° C. The initial pressure in the reactor was 60 bar and after a period of approximately 10 min the pressure was 300 bar. The cotton was dyed for 4 hours at 120° C. and 300 bar. Subsequently, the reactor was removed from the thermostatic bath and cooled down till the pressure was 60 bar. At this pressure the reactor was depressurized by opening the needle valve.

The piece of cotton was removed from the reactor and was found to display an evenly distributed yellow colour. No traces of the pre-treatment fluid media or co-solvent were found in the piece of cotton, i.e. the cotton was completely dry after the dyeing process.

To determine the fixation of the dye in the piece of cotton, a Soxhlet extraction was carried out. A half piece of the dyed cotton was extracted for 1 hour in a 15:35 (v/v) mixture of water and acetone at 85° C. The colour intensity, in terms of the K/S, was determined in the dyed and the extracted piece of cotton. The Kubelka-Munk equation, $K/S=(1-R)^2/2R$, is used to determine the colour intensity in the dyed and the extracted piece of cotton. In this equation R is the minimum value of the reflectance curve, which is measured between 350 and 750 nm with a spectrophotometer.

The results showed a K/S value of the dyed cotton of 19.6 and a K/S value of the extracted cotton of 15.8. These results show that the dyeing process produced a good colour yield as well as excellent fixation of the colour to the cotton.

Comparative Example A

The dyeing test described in example 1, was repeated without employing pre-treatment and co-solvent. Furthermore, this time the cotton was dyed for 7 h at 120° C. and 300 bar. The piece of cotton obtained after dyeing was very pale yellow and displayed an uneven colour distribution. Following the Soxhlet extraction the dye was almost completely removed from the cotton. The K/S value of the dyed cotton was 0.8 and the K/S value of the Soxhlet extracted cotton was 0.5.

Thus, it can be concluded that without pre-treatment and co-solvent the dyeing in supercritical carbon dioxide with the reactive dyestuff is ineffective even when prolonged dyeing times are employed.

Comparative Example B

The dyeing test described in example 1, was repeated without employing pre-treatment. Furthermore, this time the cotton was dyed for 7 h at 120° C. and 300 bar. The piece of cotton obtained after dyeing was light yellow. Following the Soxhlet extraction a lighter yellow colour was observed. The K/S value of the dyed cotton was 7.8 and the K/S value of the Soxhlet extracted cotton was 5.8

Thus, it can be concluded that without pre-treatment the dyeing in supercritical carbon dioxide with the reactive dyestuff is ineffective even when prolonged dyeing times are employed

Example 2

The experimental procedure described in example 1 was applied to 0.25 g of mercerized cotton. In this experiment instead of methanol as co-solvent, ethanol was used, also in a concentration of 2% by weight of carbon dioxide. The result after 4 hours dyeing at 140° C. and 300 bar was a yellow piece of cotton that was evenly dyed. The K/S value after dyeing was 25.3 and K/S after extraction was 19.7

Example 3

A piece of 0.25 g of mercerized cotton was dyed following the procedure described in example 1, except that this time the reactive disperse dye employed was 4,6-dichloro-N-[4-(phenyldiazinyl)phenyl]-1,3,5-trazin-2-amine. The dichlorotriazinyl derivative was applied at an owf of 5% as an owf of 10% was found to cause damage to the cotton as a result of the production of significant quantities of hydrochloric acid. The dyeing process with the dichlorotriazinyl derivatised dyestuff was carried out for 7 h.

The result of this experiment was a yellow piece of cotton that was evenly dyed. The K/S values after dyeing and extraction were 9.0 and 7.7 respectively. Thus, it can be concluded that the piece of cotton dyed with the difluorotriazinyl derivatised dye shows a stronger colouration than the cotton dyed with the dichlorotriazinyl derivatised dye, even when the dyeing time employed for the latter dye was 3 hours longer than for the difluorotriazinyl derivatised dye.

Example 4

Example 1 was repeated using a different reactive disperse dye, i.e. 6-fluoro-N-[4-(phenyldiazinyl)phenyl]-1,3,5-trazin-2,4-diamine.

The cotton dyed with the aminomonofluorotriazinyl dye was found to be evenly dyed. The K/S values observed for the aminomonofluorotriazinyl dye were 15.5 after dyeing and 12.3 after extraction.

Example 5

Example 1 was repeated using a different reactive disperse dye 6-chloro-N-[4-(phenyldiazinyl)phenyl]-1,3,5-trazin-2,4-diamine This time the dyeing time employed was 7 h.

For the aminomonochlorotriazinyl dye the K/S values were 11.1 after dyeing and 5.2 after extraction.

Example 6

Example 1 was repeated using 4-fluoro-6-methoxy-N-[4-(phenyldiazenyl)phenyl]-1,3,5-triazin-2-amine as the reactive disperse dye and employing a dyeing time of 7 hours.

The dyed cotton piece so obtained was found to be evenly dyed. The K/S values observed were 15.6 after dyeing and 10.1 after extraction.

Example 7

The experimental procedure described in example 6 was repeated except that the piece of pre-treated cotton was placed into the batch reactor together with the reactive disperse dye, the co-solvent and an acid ($H_3PO_4$). The concentration of $H_3PO_4$ was 4% mol calculated on the molar amount of reactive dye substance.

The result after 4 h dyeing was a yellow piece of cotton that was evenly dyed. The K/S value after dyeing was 26.5 and K/S after extraction was 20.4.

The invention claimed is:

1. A method of dyeing a substrate comprising:

(a) obtaining a substrate consisting of cellulose fibers (b) pretreating the substrate by wetting the substrate with a fluid medium comprising at least 40 wt. % of organic hydrogen bond acceptor compounds selected from the group consisting of $C_1$-$C_6$ alkanols comprising one hydroxyl group;

(c) dyeing the substrate by contacting the pre-treated substrate with supercritical or near supercritical carbon dioxide containing a reactive dyestuff.

2. The method according to claim 1, wherein the hydrogen bond acceptor compounds are selected from the group consisting of primary alcohols, secondary alcohols or combinations thereof.

3. The method according to claim 1, wherein the hydrogen bond acceptor compounds are selected from the group consisting of methanol, ethanol, propanol, iso-propanol, n-butanol and 2-butanol.

4. The method according to claim 1, wherein the supercritical or near supercritical carbon dioxide comprising the reactive dyestuff contains between 1 and 35%, by weight of the carbon dioxide, a co-solvent selected from the group consisting of organic hydrogen bond acceptor compounds with 1-10 carbon atoms and one or more functionalities selected from hydroxyl, ester, ketone, sulfoxide, sulfone, ether, amine oxide, tertiary amide, phosphate, carbonate, carbamate, urea, phosphine oxide and nitrile.

5. The method according to claim 1, wherein the dyeing is carried out at a temperature of 80-300° C. and a pressure of 60-500 bar.

6. The method according to claim 1, wherein the supercritical or near supercritical carbon dioxide further comprises at least 0.05 mol. % of an acid calculated on molar amount of reactive dyestuff substance that is used in the dyeing process.

7. The method according to claim 6, wherein the supercritical or near supercritical carbon dioxide contains at least 1 mol. % of an acid calculated on molar amount of reactive dyestuff substance that is used in the dyeing process.

8. The method according to claim 6, wherein the acid is selected from the group consisting of HCl, $C_6H_5SO_3$, $HNO_3$, $CF_3COOH$, $H_3PO_3$, $HClO_2$, $H_3PO_4$, $CH_2ClCOOH$, HF, $HNO_2$, HCOOH, $C_6H_5COOH$, $CH_3COOH$ and $H_2CO_3$.

9. The method according to claim 1, wherein the substrate is a fibre comprising a material selected from the group consisting of cotton, wool, and combinations thereof.

10. The method according to claim 1, wherein the reactive dyestuff is a chromophore derivative comprising a chromophoric residue and a reactive group, said reactive group comprising a cyclic or heterocyclic aromatic residue that has been substituted with at least one radical selected from the group consisting of halide, optionally substituted alkoxy and optionally substituted amine and at least one radical selected from the consisting of halide, substituted or unsubstituted alkoxy, substituted or unsubstituted amine and substituted or unsubstituted thiol.

* * * * *